US006259205B1

(12) United States Patent
Wijenberg et al.

(10) Patent No.: US 6,259,205 B1
(45) Date of Patent: Jul. 10, 2001

(54) HIGH-PRESSURE DISCHARGE LAMP WITH A DISCHARGE VESSEL HAVING CONICAL OF CONCENTRIC ENDS

(75) Inventors: Christoffel Wijenberg; Bernardus L. M. Van Bakel, both of Eindhoven (NL); Ralph D. Wittig, Menlo Park; Sundararajarao Mohan, Cupertino, both of CA (US)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/207,525

(22) Filed: Dec. 8, 1998

(30) Foreign Application Priority Data

Dec. 16, 1997 (EP) ..... 97203958

(51) Int. Cl.[7] ..... H01J 17/18; H01J 61/36
(52) U.S. Cl. ..... 313/625; 313/623; 313/624
(58) Field of Search ..... 313/623, 624, 313/625, 626, 631, 634, 636, 638, 331, 332, 573, 574

(56) References Cited

U.S. PATENT DOCUMENTS 4,208,605 * 6/1980 McVey et al. ..... 313/624
4,625,149 * 11/1986 Danno et al. ..... 313/623
4,765,820 * 8/1988 Naganawa ..... 313/625
5,321,335 * 6/1994 Klung et al. ..... 313/623
5,404,078 4/1995 Bunk et al. ..... 313/625
5,424,609 6/1995 Geven et al. ..... 313/623
5,426,343 * 6/1995 Rhodes et al. ..... 313/623

* cited by examiner

*Primary Examiner*—Nimeshkumar D. Patel
*Assistant Examiner*—Mariceli Santiago
(74) *Attorney, Agent, or Firm*—Dicran Halajian

(57) ABSTRACT

A high-pressure discharge lamp includes a ceramic discharge vessel which encloses a discharge space containing two electrodes and an ionizable filling including a metal halide. The discharge vessel includes a central cylindrical part with an end, and an end part closing the cylindrical part at the end in a gastight manner. The discharge vessel also has a projecting plug connected to the end part in a gastight manner for enclosing a feedthrough conductor. The end part is monolithic and its outside surface includes an angle A with the longitudinal axis of the discharge vessel at the projecting plug, where the angle A is between 30 and 60 degrees. The outside surface of the end part may be shaped like a truncated cone with a base extending radially outward. Alternatively, the end part includes two concentric tubular portions which are interconnected in a gastight manner.

5 Claims, 4 Drawing Sheets

HIGH-PRESSURE DISCHARGE LAMP WITH A DISCHARGE VESSEL HAVING CONICAL OF CONCENTRIC ENDS

BACKGROUND OF THE INVENTION

The invention relates to a high-pressure discharge lamp comprising a ceramic discharge vessel which encloses a discharge space which contains an ionizable filling including a metal halide and which accommodates a first and a second electrode, which discharge vessel has a longitudinal axis and is provided with

- a central cylindrical part which encloses the discharge space and which is provided with an end,
- an end part which is provided with an outside surface and which closes the cylindrical part at the end in a gastight manner, and
- a projecting plug which is connected to the end part in a gastight manner by means of a sintered connection and which encloses a feedthrough conductor to the first electrode with clearance, said plug containing a seal of a sealing ceramic through which the feedthrough conductor exits.

A lamp of this type is known from U.S. Pat. No. 5,424,609. In this description and in the claims, a ceramic dischargevessel is to be taken to mean a discharge vessel provided with a wall of a refractory material, such as monocrystalline metal oxide (for example sapphire), gastight sintered polycrystalline metal oxide (for example polycrystalline aluminium oxide; yttrium aluminium granate or yttrium oxide) and polycrystalline gastight sintered non-oxidic material (for example aluminium nitride). The gastight connection between the cylindrical part and the end part is generally formed by means of a sintered connection, because this type of connection is just as resistant to high temperatures and attack as the ceramic wall portions themselves. The sintered connection to the end part extends over a length of at least 2 mm. In practice, such a length of the sintered connection proved to be sufficient to form a strong and gastight fastening, also in the case of large-scale series production. Also the sintered connection between the wall of the end part and the projecting plug extends over a length of at least 2 mm. Each sintered connection between two parts forms a sintering seam. A discharge vessel constructed in said manner can be very reproducibly produced in series on an industrial scale. It is advantageous that the discharge vessel is composed of a limited number of prefabricated shaped parts which, as a result of their relatively simple shapes, can be manufactured very accurately and subsequently sintered to form the intended ceramic body in a single sintering process. In particular with respect to the projecting plug it is observed that due to the very small cross-section dimensions of the plug in practical circumstances, the projecting plug is preferably shaped as a cylindrical tube. Such a shape is very suitable to be manufactured with high accuracy on an industrial scale in series by way of extrusion. The resultant reproducible dimensional accuracy of the discharge vessel is very important for obtaining a good color stability of the lamp during its service life.

The known lamp has a quantity of sealing ceramic at the location of the sintering seam between the outside surface of the end part and the projecting plug. This sealing ceramic may be covered with an additional slice of ceramic material. Although the risk of leakage of the discharge vessel due to cracks in the end part and/or the projecting plug as a result of thermal stresses is substantially reduced in this manner, the construction has the drawback that at least one additional process step in the manufacturing process is required. A further drawback is that, during operation of the lamp, evaporation of the sealing

SUMMARY OF THE INVENTION

To achieve this, a lamp of the type mentioned in the opening paragraph is the location of the projecting plug, the outside surface of the end part is positioned so as to be axially remote from the discharge space with respect to the outside surface at the location of the end. The lamp in accordance with the invention has the advantage that, by means of an important simplification of the manufacturing process, it has been achieved that not only the risk of leakage of the discharge vessel has been substantially reduced, but even the risk of crack formation in the end part and/or the projecting plug due to thermal stresses. As a result thereof, a reduction of the service life of the lamp due to evaporation of sealing ceramic is precluded.

In an advantageous embodiment of the lamp in accordance with the invention, the end part is monolithic and the outside surface includes an angle A with the longitudinal axis, at the location of the projecting plug, which angle, expressed in degrees, meets the following relation $30<A<60$.

This form of attachment between the end part and the projecting plug causes internal stresses to be homogeneously distributed over the end part, which has a very favorable influence on the further reduction of the risk of crack formation caused by thermal stresses. In this respect, it has been found that if the outside surface of the end part is shaped like a truncated cone provided with a foot at its base, a very robust lamp-vessel construction having favorable thermal properties is obtained. The cap may be widened with respect to the base of the cone. In another advantageous embodiment of the lamp in accordance with the invention, the end part is composed of at least two concentric tubular portions which are interconnected in a gastight manner by sintering. This embodiment has the special advantage that all prefabricated ceramic shaped parts of which the discharge vessel is composed can be formed by means of an extrusion process. The measure in accordance with the invention can be particularly advantageously applied to a lamp having a rated wattage of more than 150 W. The measure can particularly suitably be used in a metal-halide lamp.

DETAILED DESCRIPTION OF THE PREFERRED EMBODIMENTS

Figure 1:
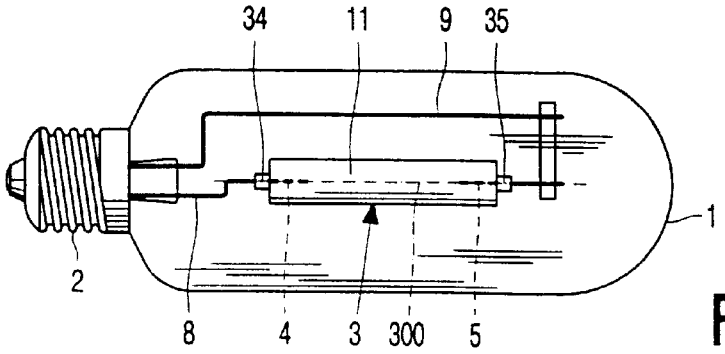
FIG. 1 schematically shows a lamp in accordance with the invention.
Figure 2:
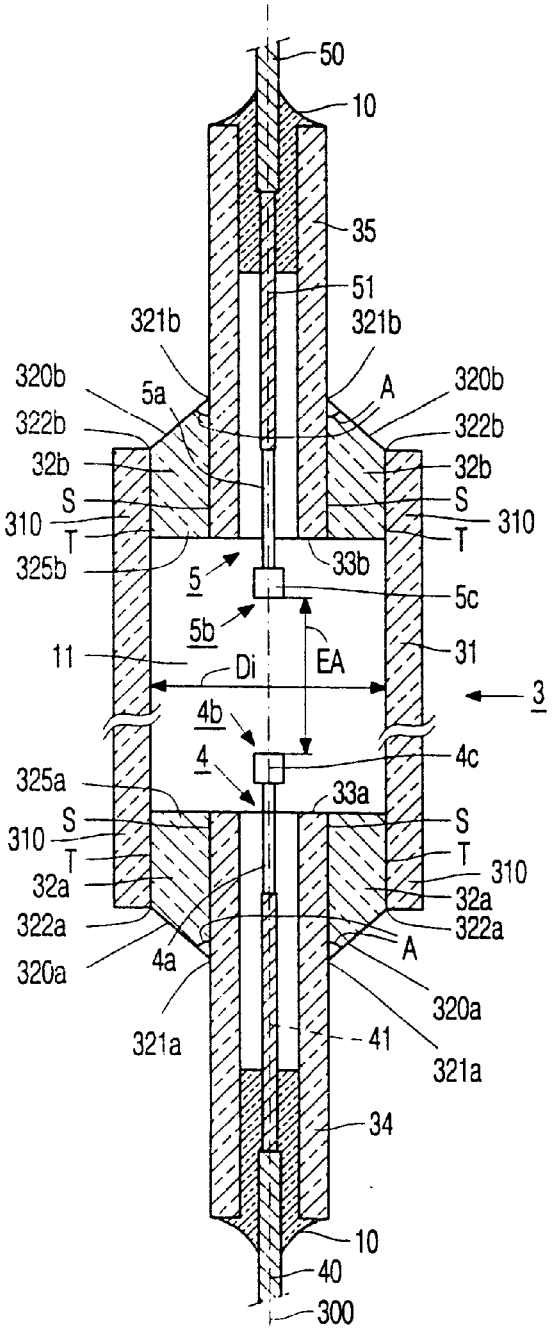
FIG. 2 shows the discharge vessel of the lamp shown in FIG. 1 in detail.

FIG. 1 shows a high-pressure discharge lamp comprising a ceramic discharge vessel 3 having a ceramic wall which encloses a discharge space 11 which contains an ionizable filling. The discharge space accommodates a first electrode 4 and a second electrode 5 having tips situated at a distance EA from one another. The discharge vessel has a longitudinal axis 300. The discharge vessel is surrounded by an outer bulb 1 which is provided at one end with a lamp cap 2. During operation of the lamp, there is a discharge between the electrodes 4, 5. Electrode 4 is connected via a current conductor 8 to a first electrical contact which forms part of the lamp cap 2. Electrode 5 is connected via a current conductor 9 to a second electrical contact which forms part of the lamp cap 2. The discharge vessel, which is shown in greater detail (not to scale) in FIG. 2, is provided with a central cylindrical part 31 which enclosesthe discharge space and which is provided with ends 310. End parts 32*a*, 32*b* are provided with outside surfaces 320*a*, 320*b*, and close the cylindrical part 31 in a gastight manner at theends 310 by means of a gastight connections T.

Projecting plugs 34, 35 are connected in a gastight manner to the end parts 32*a*, 32*b* by means of sintered connections S, and enclose feedthrough conductor 40 to the first electrode 4 and to the second electrode 5 with clearance. In each plug there is a seal of a sealing ceramic 10, 20 through which the feedthrough conductor 40, 50 exits.

The discharge vessel 3 has an inside diameter Di, at least at the location of the distance EA. Each end part 32*a*, 32*b* forms an end face 33*a*, 33*b* of the discharge space. The end parts each have an aperture in which a ceramic projecting plug 34, 35 is secured in a gastight manner in the end part 32*a*, 32*b* by means of a sintered connection S. The ceramic projecting plugs 34, 35 each closely surround a current feedthrough conductor 40, 41, 50, 51 of a relevant electrode 4, 5 provided with a tip 4*b*, 5*b*. The current feedthrough conductor is connected in a gastight manner, on the side facing away from the discharge space, to the ceramic projecting plug 34, 35 by means of a sealing ceramic connection 10.

In the lamp shown, at the location of the projecting plug 321*a*, 321*b*, the outside surface of the end part is positioned so as to be axially remote from the discharge space with respect to the outside surface at the location of the end 322*a*, 322*b*. The end parts 32*a*, 32*b* are monolithic. Since, at the location of the outside surface 320*a*, 320*b*, the sintered connection S extends parallel to the longitudinal axis 300, the outside surface of the end part 32*a*, 32*b* includes an angle A, at the location of the projecting plug 321*a*, 321*b*, with the longitudinal axis of 45 degrees and thus satisfies the relation $30<A<60$.

The outside surface 320*a*, 320*b* of the end part 32*a*, 32*b* has the shape of a truncated cone which is provided at its base with a foot 325*a*, 325*b*. In the lamp shown, the height of the foot corresponds to the length of the gastight connection T between the end 310 of the cylindrical part 31 and the end part 32*a*, 32*b*.

There is a distance EA between the electrode tips 4*b*, 5*b*. The current feedthrough conductors comprise a substantially halide-resistant part 41, 51, respectively, for example in the form of an Mo-$Al_2O_3$-cermet and a part 40, 50, respectively, which is secured in a gastight manner by means of the sealing ceramic connection 10 to a relevant end plug 34, 35. The sealing ceramic connection covers the Mo-cermet 41, 51, respectively, over some distance, for example approximately 1 mm. Instead of a Mo-$Al_2O_3$-cermet, other constructions can be used for the parts 41, 51. Other possible constructions are known, for example, from U.S. Pat. No. 5,424,609. A construction which is often used in practice consists of a substantially halide-resistant spiral wound about an also substantially halide-restant pin. Mo can very suitably be used as a substantially halide-resistant material. The parts 40, 50 are made of a metal whose coefficient of expansion corresponds well to that of the end plugs. For example, Nb is a very suitable material. The parts 40, 50 are connected, in a manner not shown in greater detail, to the current conductors 8, 9, respectively. The feedthrough construction described above enables the lamp to be operated in any burning position.

Each of the electrodes 4, 5 comprises a rod electrode 4*a*, 5*a* near the tip 4*b*, 5*b* provided with a winding 4*c*, 5*c*. The projecting ceramic plugs are secured in a gastight manner in the end wall portions 32*a* and 32*b* by means of a sintered connection S. The electrode tips are situated between the end faces 33*a*, 33*b* formed by the end wall portions. In another embodiment of a lamp in accordance with the invention, the projecting ceramic plugs 34, 35 are provided so as to be recessed with respect to the end wall portions 32*a* and 32*b*. In that case, the electrode tips are substantially situated in the end faces 33*a*, 33*b* formed by the end wall portions.

Figure 3:
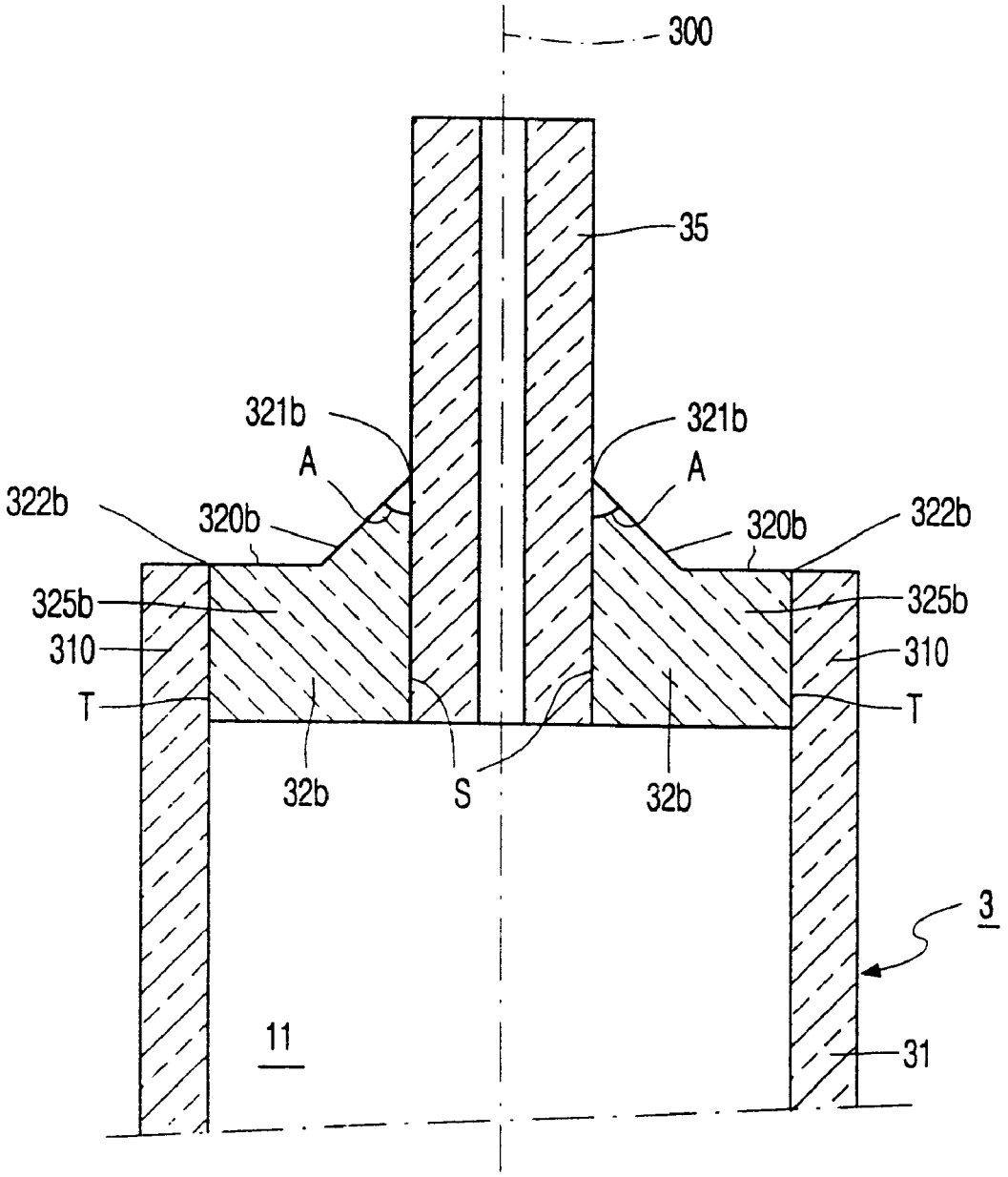
FIG. 3 shows parts of the discharge vessel according to another embodiment of the present invention.
Figure 4A:
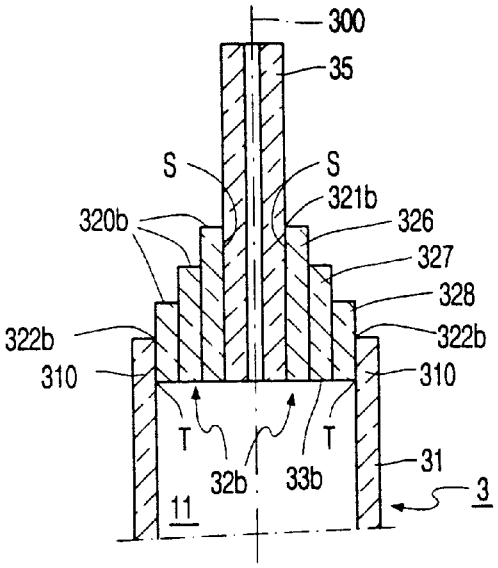
FIGS. 4A–4C show parts of the discharge vessel according to yet another embodiment of the present invention.
Figure 4B:
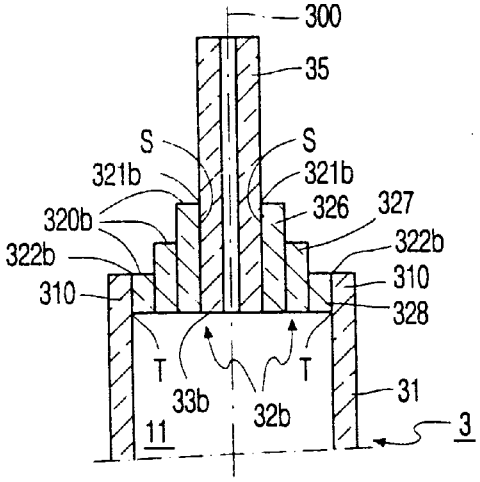
Figure 4C:
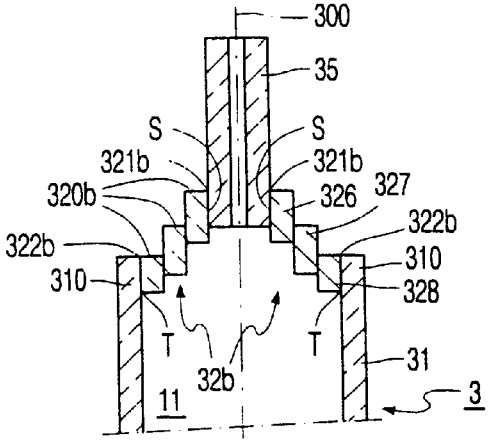
Figure 5:
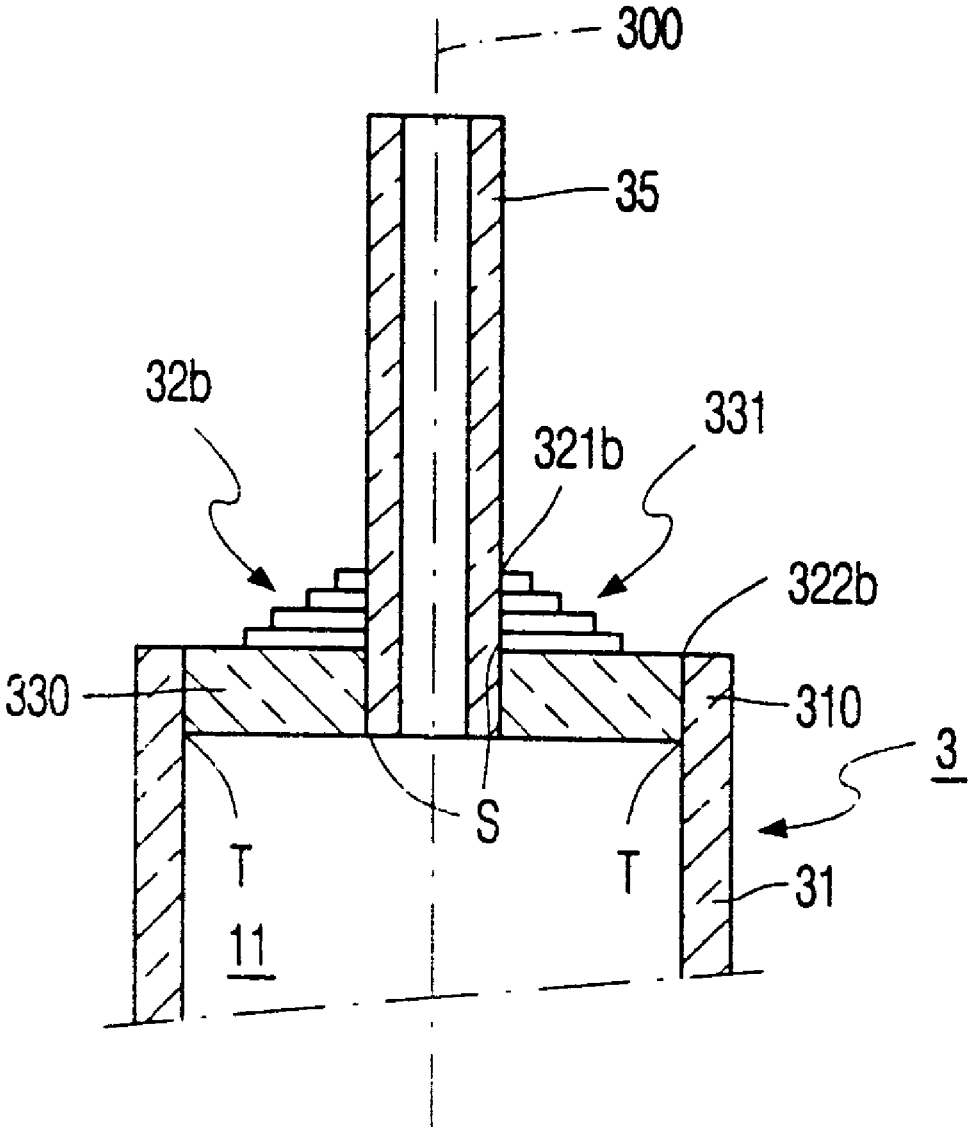
FIG. 5 shows parts of the discharge vessel according to a further embodiment of the present invention.

In FIGS. 3 through 5, variant constructions are shown of the part of the discharge vessel situated near an end of the central cylindrical part before a relevant electrode and feedthrough conductor are provided. The parts corresponding to those shown in FIGS. 1 and 2 are denoted by a corresponding reference numeral. In the variant shown in FIG. 3, the end part 32*b*, whose outside surface 320*b* is shaped like a truncated cone, has a foot 325*b* which is widened relative to the base of the cone. A difference between the embodiments of FIG. 2 and FIG. 3 is that, at the same dimension of the end, in the construction shown in FIG. 3, the end part has a smaller heat capacitance so that a smaller heat loss during operation of the lamp will take place. Particularly in the case of a lamp having a relatively low rated wattage and hence small to very small dimensions of the discharge vessel, this is to be considered an advantage.

The variants shown in FIGS. 4A, 4B and 4C, have an end part 32*b* which is composed of 3 concentric tubular portions 326, 327, 328 which are interconnected in a gastight manner by sintering. The outside surface 320*b* of end part 32*b* has a stepped shape between the outside surface of the end part at the location of the projecting plug 321*b* and the outside surface at the location of the end 322*b*. In the case of the constructions shown in FIGS. 4A and 4B, the tubular portions 326, 327, 328 form, on the side facing the discharge space 11, an end face 33*a*, 33*b* of the discharge space. In the case of the construction shown in FIG. 4C, the use of tubular portions 326, 327, 328 of substantially the same length causes the boundary of the discharge vessel at the location of the end part to be step-shaped just like the outside surface 320*b*. Particularly if heat losses should be minimized, this is an advantageous shape of the discharge vessel 3. All constructions in accordance with FIGS. 4A, 4B, 4C have the advantage that all prefabricated ceramic shaped parts of which the discharge vessel is composed can be made by means of an extrusion process, so that the ceramic shaped parts, and hence the discharge vessels produced therefrom, can be very accurately reproduced on an industrial scale.

Such an advantage is also achieved in the construction shown in FIG. 5, in which the end part 32*b* is formed from a disc-shaped element 330 which is provided with a number, 4 in the example shown, of concentric discs 331 whose diameters decrease in a step-like manner. The discs are interconnected in a gastight manner by sintering. At the location of a central aperture through which the plug 35 projects, the discs are sintered to this plug in a gastight manner. Disc 330 is also connected in a gastight manner to the end 310 by means of a sintered connection T. A favorable aspect of the construction shown is that the discs 331 do not play a part in closing the discharge vessel in a gastight manner.

What is claimed is:

1. A high-pressure discharge lamp comprising a ceramic discharge vessel which encloses a discharge space which contains an ionizable filling including a metal halide and which accommodates a first electrode and a second electrode, which discharge vessel has a longitudinal axis and comprises a central cylindrical part comprising an end, an end part comprising an outside surface and closing the cylindrical part at the end in a gastight manner, and a projecting plug connected to the end part in a gastight manner and which encloses a feedthrough conductor to the first electrode, wherein the end part is monolithic and the outside surface includes an angle A with the longitudinal axis at the projecting plug, wherein said angle A, expressed in degrees, meets the relation $30<A<60$.

2. A high-pressure discharge lamp comprising a ceramic discharge vessel which encloses a discharge space which contains an ionizable filling including a metal halide and which accommodates a first electrode and a second electrode, which discharge vessel has a longitudinal axis and comprises a central cylindrical part comprising an end, an end part comprising an outside surface and closing the cylindrical part at the end in a gastight manner, and a projecting plug connected to the end part in a gastight manner and which encloses a feedthrough conductor to the first electrode, wherein the outside surface of the end part is shaped like a truncated cone and a base extending radially outward.

3. A high-pressure discharge lamp comprising a ceramic discharge vessel which encloses a discharge space which contains an ionizable filling including a metal halide and which accommodates a first electrode and a second electrode, which discharge vessel has a longitudinal axis and comprises a central cylindrical part comprising an end, an end part comprising an outside surface and closing the cylindrical part at the end in a gastight manner, and a projecting plug connected to the end part in a gastight manner and which encloses a feedthrough conductor to the first electrode, wherein the end part comprises two concentric portions which are interconnected in a gastight manner.

4. The high-pressure discharge lamp of claim 3, wherein said two concentric portions are tubular.

5. The high-pressure discharge lamp of claim 3, wherein said two concentric portions are disc-shaped.

* * * * *